US005181498A

United States Patent [19]

Koiwa et al.

[11] Patent Number: 5,181,498

[45] Date of Patent: Jan. 26, 1993

[54] IGNITION APPARATUS FOR AN INTERNAL COMBUSTION ENGINE

[75] Inventors: Mitsuru Koiwa; Shingo Morita, both of Himeji, Japan

[73] Assignee: Mitsubishi Denki Kabushiki Kaisha, Tokyo, Japan

[21] Appl. No.: 794,231

[22] Filed: Nov. 19, 1991

[30] Foreign Application Priority Data

Nov. 21, 1990 [JP] Japan ..... 2-121183[U]

[51] Int. Cl.[5] ..... F02P 11/00

[52] U.S. Cl. ..... 123/633; 123/605

[58] Field of Search ..... 123/605, 633, 635, 601, 123/618, 634, 654, 652, 604, 597, 598; 315/209 R

[56] References Cited

U.S. PATENT DOCUMENTS

| | | | |
|---|---|---|---|
| 4,036,201 | 7/1977 | Burson | 123/601 |
| 4,369,758 | 1/1983 | Endo | 123/633 |
| 4,391,236 | 7/1983 | Anderson | 123/605 |
| 4,451,764 | 5/1984 | Gerry | 315/209 R |
| 4,502,454 | 3/1985 | Hamai et al. | 123/635 |
| 4,619,241 | 10/1986 | Yoshinari | 123/605 |
| 4,620,521 | 11/1986 | Henderson et al. | 123/601 |
| 4,733,646 | 3/1988 | Iwasaki | 123/597 |
| 4,829,971 | 5/1989 | Minks | 123/598 |
| 5,074,274 | 12/1991 | Okuda | 123/604 |

FOREIGN PATENT DOCUMENTS

| | | | |
|---|---|---|---|
| 191383 | 12/1983 | Japan | 123/633 |
| 14970 | 1/1984 | Japan | 123/633 |

*Primary Examiner*—Raymond A. Nelli

*Attorney, Agent, or Firm*—Sughrue, Mion, Zinn, Macpeak and Seas

[57] ABSTRACT

An ignition apparatus for an internal combustion engine is able to reduce generation of noise and energy loss due to wiring to a substantial extent. A capacitor 4 is connected at one end thereof to a DC power supply so as to be charged thereby, and at the other end thereof to an ignition coil 5. A switching element 9 is connected between the capacitor and a primary winding of the ignition coil to form part of a discharge path through which the capacitor discharges. The switching element is made conductive by means of an ignition or trigger signal which is generated by a signal generator in synchronism with the rotation of the engine, so that the charged capacitor discharges through the primary winding of the ignition coil. The capacitor, the ignition coil and the switching element are formed integrally with each other, housed in a single casing 13 and connected to each other without the use of a wire harness.

1 Claim, 3 Drawing Sheets

IGNITION APPARATUS FOR AN INTERNAL COMBUSTION ENGINE

BACKGROUND OF THE INVENTION

The present invention relates to an ignition apparatus for an internal combustion engine, and more particularly, to such an ignition apparatus of the capacitor discharge ignition (CDI) type.

FIG. 3 shows a typical example of such an ignition apparatus of the capacitor discharge ignition type for an internal combustion engine. In this figure, a DC power source 1 in the form of a battery for use with a motor vehicle is connected to a DC-DC converter or amplifier 2 which serves to convert or amplify the output voltage of the battery 1 to several hundred volts. A rectifying diode 3 has an anode coupled to an output terminal of the converter 2 and a cathode coupled to one end of a capacitor 4, the other end of which is connected to an ignition coil 5. The ignition coil 5 has a primary winding and a secondary winding which is connected to a spark plug 6. An ignition signal generator 7 is connected to the battery 1 at a node between the battery 1 and the converter 2, and it generates an ignition signal in synchronism with the rotation of an internal combustion engine (not shown). A trigger circuit 8 is connected to the battery 1 and the ignition signal generator 7 for generating a trigger signal in response to an ignition signal from the ignition signal generator 7. The ignition signal generator 7 and the trigger circuit 8 together constitute a signal generating means. A switching element 9 in the form of a thyristor has an anode connected to a node between the rectifying diode 3 and the capacitor 4 and a cathode connected to the primary winding of the ignition coil 5 and to ground. The thyristor 9 has a control gate connected to an output terminal of the trigger circuit 8 so that it is made conductive or switched on by a trigger signal from the trigger circuit 8 to thereby allow the capacitor 4, which is charged by the battery 1 through the DC-DC converter 2 and the rectifying diode 3, to discharge by way of the primary winding of the ignition coil 5. The DC-DC converter 2, the diode 3, the capacitor 4, the ignition signal generator 7, the trigger circuit 8 and the switching element 9 are housed in a power unit 10, as depicted by a phantom line in FIG. 3, whereas the ignition coil 5 is housed in a casing 11 disposed separately from the power unit 10, the ignition coil 5 being connected to the elements in the power unit 10 by means of a wire harness 12 which includes a conductor wire **12*a* connected between the capacitor 4 and the ignition coil 5 and a conductor wire 12*b* connected between the primary winding of the ignition coil 5 and the switching element 9**.

In operation, the DC-DC converter 2 increases or amplifies the DC voltage generated by the battery 1 to an enlarged voltage of several hundred volts, which is then supplied via the rectifying diode 3 to the capacitor 4 for charging it. When the switching element 9 is made conductive or turned on by a trigger signal from the trigger circuit 8, which is generated in response to an ignition signal produced by the ignition signal generator 7 at a predetermined crankshaft position or ignition timing, the charged capacitor 4 begins to discharge by way of a closed discharge path comprising the capacitor 4, the switching element 9, the conductor wire **12*b*, the primary winding of the ignition coil 5, the conductor wire 12*a* and the capacitor 4. As a result, a high voltage is developed across the secondary winding of the ignition coil 5, thus causing the spark plug 6** to generate a spark.

With the known ignition apparatus as described above, upon discharge of the charged capacitor 4, a large discharge current flows through the discharge path including the now conductive switching element 9, the wire harness 12 and the ignition coil 5. In this connection, however, since the ignition coil 5 alone is formed separately from, and connected through the wire harness 12 to, the other components such as the capacitor 4 and the switching element 9 included in the discharge path, the discharge path becomes long. That is, the use of the wire harness 12 connecting the ignition coil 5 with the capacitor 4 and the switching element 9 inevitably results in a long or elongated discharge path, which not only forms a major noise source but also leads to a relatively large loss in electrical energy.

SUMMARY OF THE INVENTION

Accordingly, the present invention is aimed at overcoming the above-described problems encountered with the known ignition apparatus.

An object of the invention is to provide a novel and improved ignition apparatus for an internal combustion engine which is able to reduce generation of noise and energy loss due to wiring to a substantial extent.

In order to achieve the above object, there is provided an ignition apparatus for an internal combustion engine, comprising: a DC power supply; signal generating means for generating a trigger signal in synchronism with the rotation of the engine; an ignition coil having a primary winding and a secondary winding which is connected to a spark plug; a capacitor having one end thereof connected to the DC power supply so as to be charged thereby, and the other end thereof connected to the ignition coil; and a switching element connected between the capacitor and the primary winding of the ignition coil to form part of a discharge path through which the capacitor discharges, the switching element being made conductive by means of a trigger signal generated by the signal generating means to allow the capacitor to discharge through the primary winding of the ignition coil. The capacitor, the ignition coil and the switching element are formed integrally with each other.

The capacitor, the ignition coil and the switching element are housed in a single casing and connected to each other without the use of a wire harness.

The above and other objects, features and advantages of the present invention will become more readily apparent from the ensuing detailed description of a preferred embodiment of the invention taken in conjuction with the accompanying drawings.

BRIEF DESCRIPTION OF THE DRAWINGS

In the drawings, the same or corresponding parts are identified by the same symbols.

DESCRIPTION OF THE PREFERRED EMBODIMENT

A preferred embodiment of the present invention will now be described in detail with reference to the accompanying drawings.

Figure 1:
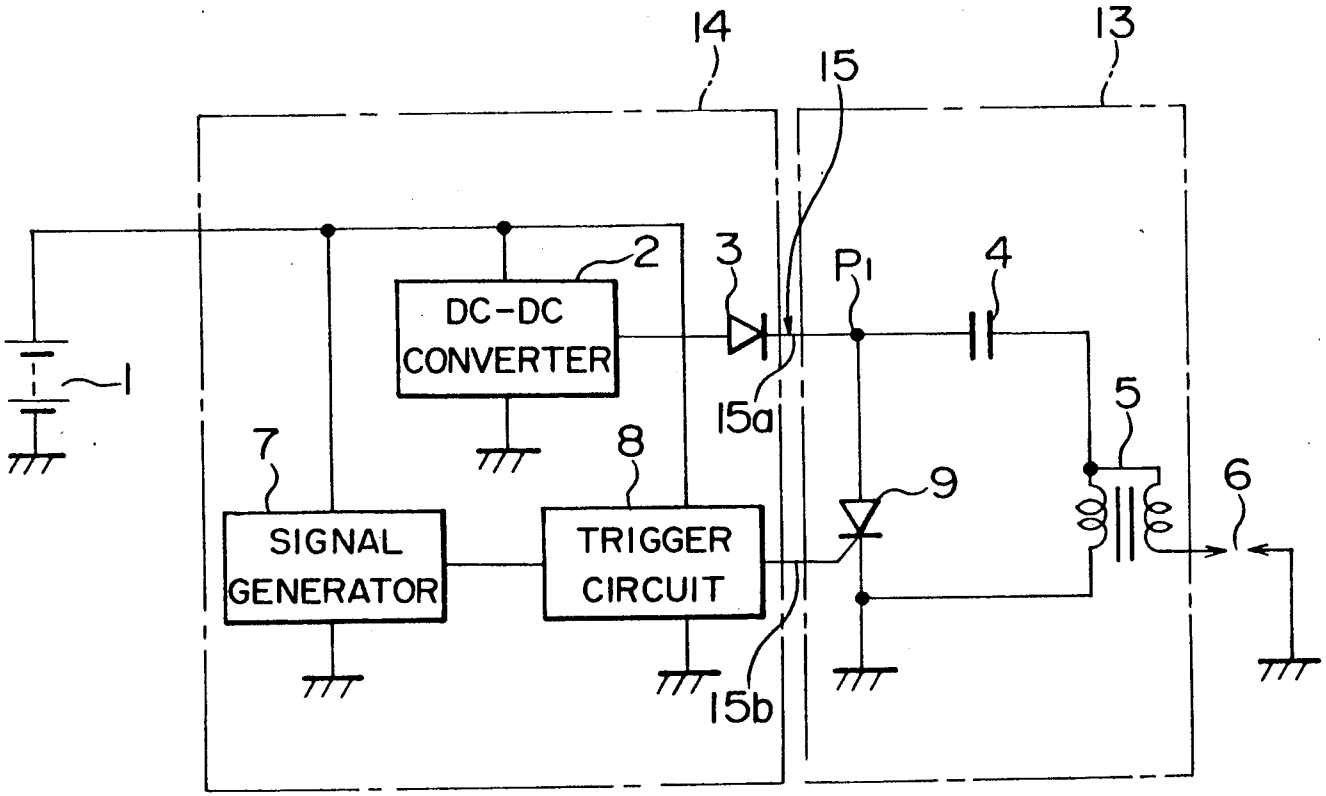
FIG. 1 is a circuit diagram showing the general arrangement of an ignition apparatus for an internal combustion engine in accordance with the present invention.

Referring to the drawings and first to FIG. 1, there is shown the circuit arrangement of an ignition apparatus for an internal combustion engine in accordance with the present invention. As is clear from a comparison of the present apparatus of FIG. 1 with the aforementioned known apparatus of FIG. 3, the apparatus of the invention is substantially similar in construction and operation to that of FIG. 3 except for the following features. Specifically, in the present invention, a capacitor 4, an ignition coil 5 and a switching element 9 are integrally formed with each other and housed in a single casing 13, which is formed separately from or independently of a power unit 14 which includes a DC-DC converter or amplifier 2, a rectifying diode 3, an ignition signal generator 7 and a trigger circuit 8, all of which are housed in another casing. Some of the elements in the casing 13 are connected to some of the elements in the power unit 14 through a wire harness 15 which includes a conductor wire 15*a* connecting a junction $P_1$ between the capacitor 4 and the switching element 9 to the rectifying diode 3, and another conductor wire 15*b* connected between a control gate of the switching element 9 in the form of a thyristor and the trigger circuit 8.

In this connection, a DC power source 1, the DC-DC converter or amplifier 2 and the rectifying diode 3 together constitute a DC power supply.

Here, it should be noted that the wire harness 15 does not form part of a discharge path through which the capacitor 4 discharges. Thus, the current flowing through this wire harness 15 is a relatively weak current of a limited magnitude, so it no longer becomes a noise source and produces substantially no or little energy loss.

Figure 2A:
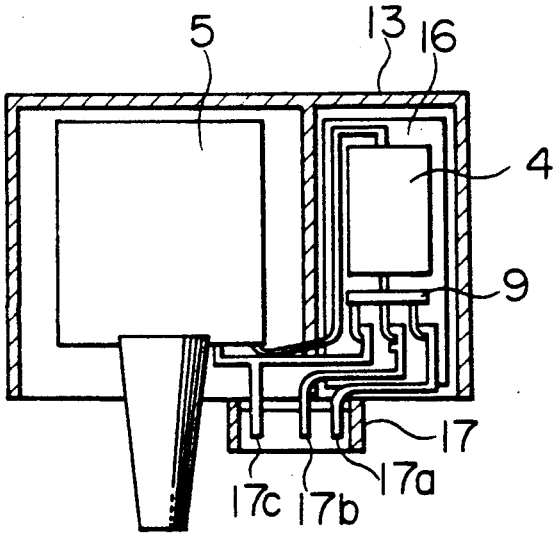
FIG. 2A is a partially cut-away plan view of the apparatus of FIG. 1.
Figure 2B:
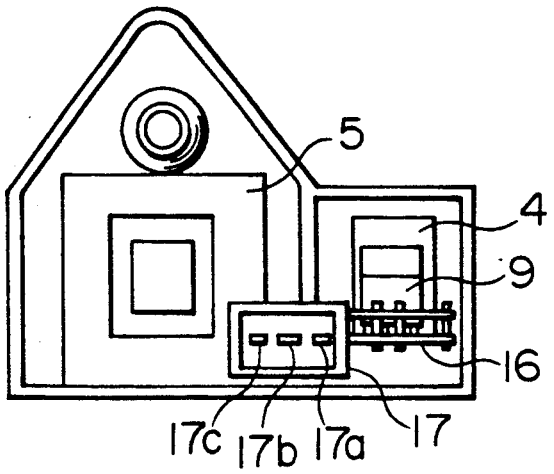
FIG. 2B is a front elevation of the apparatus of FIG. 1.

FIGS. 2A and 2B show, in a partially cut-away plan view and a front elevation, respectively, a concrete arrangement of a portion of the apparatus of FIG. 1 in which the capacitor 4, the ignition coil 5 and the switching element 9 are housed in the casing 13. In these figures, the capacitor 4 and the switching element 9 are mounted on a base or substrate board 16, and the control gate of the switching element 9 is connected to a trigger signal input terminal 17*a* of a connector 17 which is integrally formed with the casing 13. The switching element 9 has an anode connected to an input terminal 17*b* of the connector 17 and a cathode connected to a ground terminal 17*c* of the connector 17. The capacitor 4 is connected to the primary winding of the ignition coil 5. Due to this integral arrangement of the capacitor 4, the ignition coil 5 and the switching element 9 within the casing 13, it becomes possible to shorten the discharge path for the capacitor 4 to a substantial extent as compared with the known apparatus of FIG. 3.

Figure 3:
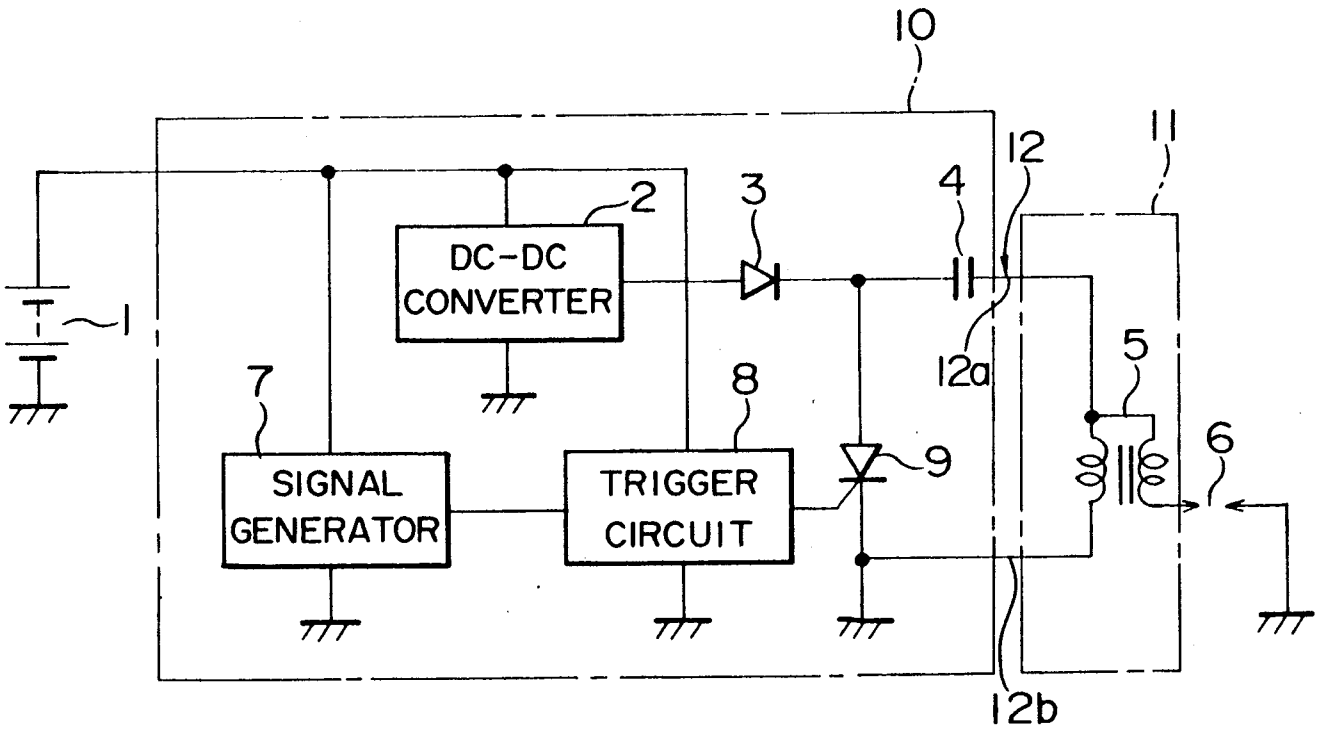
FIG. 3 is a view similar to FIG. 1, but showing a known ignition apparatus for an internal combustion engine.

The operation of this embodiment other than above is substantially similar to that of the aforementioned apparatus of FIG. 3, and hence a detailed description thereof will be unnecessary.

What is claimed is:

1. A capacitor discharge ignition apparatus for an internal combustion engine, comprising:

a) a DC power supply (1, 2, 3) for outputting a relatively low voltage charging current;

b) signal generating means (7) for generating a relatively low voltage trigger signal output in synchronism with the rotation of the engine;

c) an ignition coil (5) having a primary winding and a secondary winding which is connected to a spark plug;

d) a capacitor (4) having one end thereof connected to one end of the primary winding of said ignition coil;

e) a switching element (9) connected in series between another, opposite end of said capacitor and another, opposite end of the primary winding of said ignition coil to form a high voltage discharge path for said capacitor;

f) wiring harness means (15) connecting an output of said DC power supply to said another end of said capacitor to charge the capacitor, and connecting the trigger signal output of the signal generating means to a control terminal of the switching element; and g) a single, unitary casing (13) surrounding, housing and mounting, exclusively, the ignition coil, the capacitor, the switching element and all wiring connections therebetween to minimize the length of said wiring connections and to attendantly reduce noise signals generated by the high voltage discharge of said capacitor and minimize energy loss in said wiring connections.

* * * * *